US010198971B1

(12) United States Patent
Valenti, Jr. et al.

(10) Patent No.: US 10,198,971 B1
(45) Date of Patent: Feb. 5, 2019

(54) LABEL WITH REMOVABLE SECTION

(71) Applicant: Chicago Tag & Label, Inc., Libertyville, IL (US)

(72) Inventors: F. Paul Valenti, Jr., Barrington, IL (US); Carl Opel, Carol Stream, IL (US); Daniel Hedger, Grayslake, IL (US)

(73) Assignee: Chicago Tag & Label, Inc., Libertyville, IL (US)

( * ) Notice: Subject to any disclaimer, the term of this patent is extended or adjusted under 35 U.S.C. 154(b) by 0 days.

(21) Appl. No.: 15/293,397

(22) Filed: Oct. 14, 2016

Related U.S. Application Data

(60) Provisional application No. 62/242,584, filed on Oct. 16, 2015.

(51) Int. Cl.

| | |
|---|---|
| ***B26D 9/00*** | (2006.01) |
| ***G09F 3/02*** | (2006.01) |
| ***G09F 3/10*** | (2006.01) |

(52) U.S. Cl.
CPC ..... *G09F 3/02* (2013.01); *G09F 3/10* (2013.01); *G09F 2003/0257* (2013.01); *G09F 2003/0269* (2013.01)

(58) Field of Classification Search
CPC ..... G09F 2003/0269
USPC ..... 428/43
See application file for complete search history.

(56) References Cited

U.S. PATENT DOCUMENTS 5,761,982 A * 6/1998 Abt ..... B26D 7/20 83/861

* cited by examiner

*Primary Examiner* — Brent T O'Hern
(74) *Attorney, Agent, or Firm* — Ice Miller LLP

(57) ABSTRACT

A multi-layer label system. A carrier material with an upper label and a lower label removably adhered thereto is provided. The upper label and lower label are dispensed from the carrier and applied to a surface, whereby after application the underside of the lower label is in contact with the surface and the undersurface of the upper label is in contact with the top side of the lower label.

16 Claims, 7 Drawing Sheets

LABEL WITH REMOVABLE SECTION

CROSS-REFERENCE TO RELATED APPLICATIONS

The present application is a non-provisional of, and claims priority to U.S. Provisional Patent Application No. 62/242,584, filed Oct. 16, 2015, and having the title "LABEL WITH REMOVABLE SECTION," the disclosure of which is incorporated by reference in its entirety.

BACKGROUND

Labels are commonly used to secure printed indicia to packages to indicate shipping or other information. In the instance of a shipping use, a separate packing list may be enclosed within a package shipped to the customer containing a purchased item.

There is significant demand for a labeling method that allows automatic printing and application of a lower label and an upper label to a surface. For example, there is significant demand for a labeling method that allows automatic printing and application of a packing list and shipping label to the surface of a sealed carton. Because the carton is sealed prior to packing list generation, it is not efficient to open it to insert a packing list. High volume shipping of such packages requires rapid attachment of a packing list and a shipping label to the package. It is preferred to conceal the information of the packing list until the final recipient receives the shipped package.

For the foregoing reasons, it is desired to provide labeling forms and methods that allows automatic printing and application of a packing list label and shipping label to the surface of a sealed carton while avoiding the many shortcomings of existing labeling forms and methods.

SUMMARY

The present disclosure includes disclosure of at least one system of labels for automatic application to a surface. In at least one embodiment, a label system according to the present disclosure comprises a carrier material, an upper label, and a lower label. An upper label of at least one such embodiment comprises a top surface and an opposing undersurface, the top surface and the undersurface having a leading edge and a trailing edge, and the undersurface in contact with the carrier material. A lower label of at least one such embodiment comprises a top side and an opposing underside, the top side and the underside having a leading margin and a trailing margin, and the underside being in contact with the carrier material. According to at least one such embodiment of the present disclosure, the upper label and the lower label are in contact with the carrier material in adjacent positions with the trailing edge adjacent to the leading margin, and the upper label and the lower label are configured for dispensing sequentially from the carrier material onto a label applicator apparatus such that when the upper label and the lower label are dispensed onto the label applicator apparatus the lower label is positioned against the undersurface of the upper label prior to attachment of the upper label and the lower label to an article.

In an aspect of at least one embodiment of the present disclosure, an upper label comprises a removable segment and a lower label comprises a removable region, and when the upper label and the lower label are dispensed onto a label applicator apparatus, the removable segment and the removable region are in registration.

In an aspect of at least one embodiment of the present disclosure, an undersurface comprises a zone with reduced adhesive properties and an underside comprises an area with reduced adhesive properties, and when an upper label and a lower label are dispensed onto a label applicator apparatus the zone with reduced adhesive properties and the area with reduced adhesive properties are in registration.

In an aspect of at least one embodiment of the present disclosure, the zone with reduced adhesive properties comprises an adhesive layer covered with an adhesive deadening agent.

In an aspect of at least one embodiment of the present disclosure, the area with reduced adhesive properties comprises an adhesive layer covered with an adhesive deadening agent.

In an aspect of at least one embodiment of the present disclosure, an upper label comprises one or more holes therethrough, and when the upper label and a lower label are dispensed onto a label applicator apparatus, the lower label is held in position against the undersurface of the upper label by a vacuum force generated by the label applicator apparatus, the vacuum force acting through the one or more holes.

In an aspect of at least one embodiment of the present disclosure, all of the underside comprises reduced adhesive properties.

In an aspect of at least one embodiment of the present disclosure, all of the underside comprises an adhesive layer covered with an adhesive deadening agent.

In an aspect of at least one embodiment of the present disclosure, the undersurface comprises pressure sensitive adhesive that removeably adheres the undersurface to the carrier material.

In at least one embodiment, a label system according to the present disclosure comprises a carrier material, an upper label, and a lower label. An upper label of at least one such embodiment is removably adhered to the carrier material, and comprises a top surface, an undersurface, and a removable segment. An upper label of at least one such embodiment is bounded by a leading edge, a trailing edge, and first and second side edges. The undersurface of an upper label of at least one such embodiment comprises adhesive on at least a portion thereof and such an upper label is removeably adhered to the carrier material by the adhesive. A lower label of at least one such embodiment is removeably adhered to the carrier material in a position on the carrier material adjacent to the upper label and comprises a top side and an opposing underside. A lower label of at least one such embodiment is bounded by a leading margin, a trailing margin, and a first and second side margins. According to at least one such embodiment of the present disclosure, the upper label and the lower label are configured for dispensing sequentially from the carrier material onto a label applicator apparatus, such that when the upper label and the lower label are dispensed onto the label applicator apparatus the top surface is positioned against the label applicator apparatus, the top side of lower label is positioned against the undersurface of the upper label, and the underside is exposed.

In an aspect of at least one embodiment of the present disclosure, the top side of an upper label comprises a first surface area circumscribed by the leading margin, the trailing margin, and the first and second side margins, and the top surface of a lower label comprises a second surface area circumscribed by the leading edge, the trailing edge, and the first and second side edges, and the second surface area is not larger than the first surface area.

In at least one embodiment, a label system according to the present disclosure comprises a carrier material, a removable upper label on the carrier material, and a removable lower sheet on the carrier material in a position on the carrier material adjacent to the upper label. An upper label of at least one such embodiment comprises a top surface and an opposing undersurface, the undersurface facing the carrier material. A lower sheet of at least one such embodiment comprises a top side and an opposing underside, the underside facing the carrier material. According to at least one such embodiment of the present disclosure, wherein the upper label and the lower sheet are configured for dispensing sequentially from the carrier material onto a label applicator apparatus such that the top side of the lower sheet is positioned against the undersurface when the upper label and the lower sheet are dispensed onto the label applicator apparatus.

In an aspect of at least one embodiment of the present disclosure, an upper label comprises a removable segment, and a lower sheet comprises a removable region, and when the lower sheet is dispensed onto the label applicator apparatus, the removable segment and the removable region are in registration.

In an aspect of at least one embodiment of the present disclosure, the undersurface of an upper label comprises a zone with reduced adhesive properties, and the underside of a lower sheet comprises an area with reduced adhesive properties, and when the lower sheet is dispensed onto the label applicator apparatus, the zone with reduced adhesive properties and the area with reduced adhesive properties are in registration.

In an aspect of at least one embodiment of the present disclosure, the zone with reduced adhesive properties comprises an adhesive layer covered with an adhesive deadening agent.

In an aspect of at least one embodiment of the present disclosure, the area with reduced adhesive properties comprises an adhesive layer covered with an adhesive deadening agent.

In an aspect of at least one embodiment of the present disclosure, an upper label comprises one or more holes therethrough, and a lower sheet is held in position against the undersurface of the upper label by the vacuum force generated by a label applicator apparatus, the vacuum force acting through the one or more holes.

In an aspect of at least one embodiment of the present disclosure, a lower sheet is held in position against the undersurface of the upper label by a vacuum force generated by a label applicator apparatus.

In an aspect of at least one embodiment of the present disclosure, all of the underside of a lower sheet comprises reduced adhesive properties.

In an aspect of at least one embodiment of the present disclosure, all of the underside of a lower sheet comprises an adhesive layer covered with an adhesive deadening agent.

In an aspect of at least one embodiment of the present disclosure, the undersurface of an upper label comprises adhesive, and when a lower sheet is dispensed onto the label applicator apparatus the adhesive on the undersurface adhesively interacts with the top side of the lower sheet.

BRIEF DESCRIPTION OF THE DRAWINGS

The features and advantages of this disclosure, and the manner of attaining them, will be more apparent and better understood by reference to the following descriptions of the disclosed methods and systems, taken in conjunction with the accompanying drawings, wherein.

DESCRIPTION

Figure 1A:
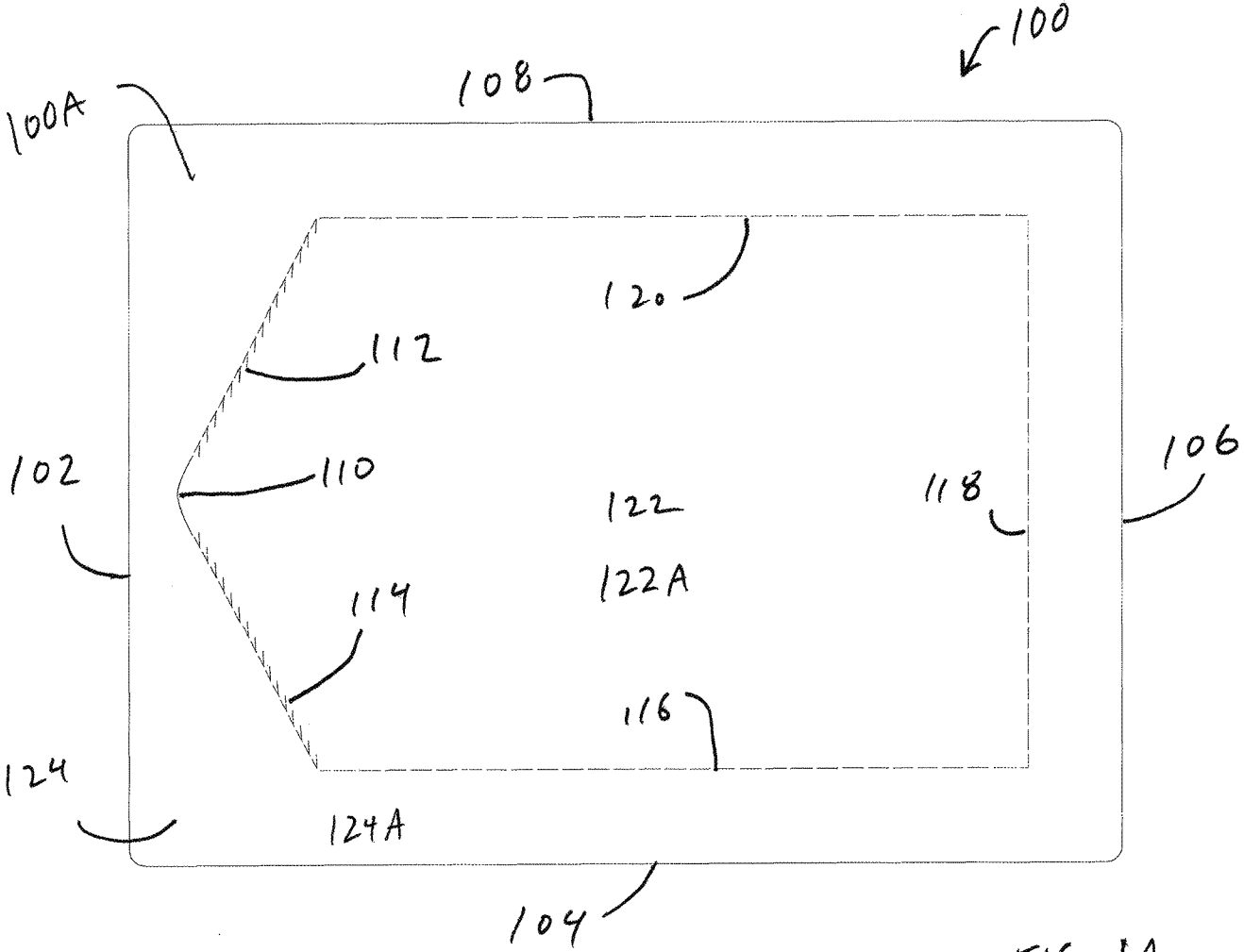
FIG. 1A shows the upper side of a label according to at least one embodiment of the present disclosure.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

FIG. 1A shows upper side 100A of label 100 according to at least one embodiment of the present disclosure. In at least one embodiment of the present disclosure, label 100 comprises a label stock material such as, for example, paper, polyester, or another polymer material. In at least one embodiment of the present disclosure, label 100 comprises a label stock material receptive to the printing of indicia thereon. For example, label 100 may be exposed to an ink jet printer, a laser printer, a thermal transfer printer, a direct thermal printer, or another type of printing device capable of applying indicia to label 100. The inks, toners, and/or other printing materials used in the application of indicia to label 100 are selected to be compatible with the printing device used to apply such indicia, the material used for label 100, and the intended use of label 100.

As shown in FIG. 1A, label 100 is bounded by leading edge 102, trailing 106, and side edges 104, 108. Label 100 also comprises removable region 122 and frame region 124. Removable region 122 comprises removable region upper surface 122A, and is bounded by lines of weakness 110, 112, 114, 116, 118, 120. Frame region 124 comprises the portion of label 100 outside of lines of weakness 110, 112, 114, 116, 118, 120, but within leading edge 102, trailing edge 106, and side edges 104, 108. As shown in FIG. 1A, frame region 124 comprises frame region upper surface 124A. In at least one embodiment of the present disclosure, indicia is added to upper side 100A of label 100. For example, indicia may be added to removable region upper surface 122A of label 100, or to frame region upper surface 124A of label 100, or to both removable region upper surface 122A and frame region upper surface 124A of label 100.

Lines of weakness 110, 112, 114, 116, 118, 120 serve to weaken the boundary between removable region 122 and frame region 124, facilitating the removal of removable region 122 from frame region 124 as discussed hereinafter. Lines of weakness 110, 112, 114, 116, 118, 120 may comprise cuts or perforations that extend partially or completely through label 100. In at least one embodiment of label 100, lines of weakness 110, 112, 114, 116, 118, 120 are inboard of the boundary of label 100 formed from leading edge 102, trailing 106, and side edges 104, 108.

In at least one embodiment of label 100, line of weakness 110 comprises a curvilinear cut that completely severs removable region 122 from frame region 124. In at least one embodiment of label 100, line of weakness 110 comprises a curvilinear cut that is the connecting an end of line of weakness 112 to an end of line of weakness 114.

In at least one embodiment of label 100, lines of weakness 112, 114 each comprises a series of angular perforations generally having a V-shape or a Y-shape. The vertex of each angular perforation of line of weakness 112 is oriented in the direction of line of weakness 120, as shown in FIG. 1A. The series of angular perforations comprising line of weakness 112 is arranged so that one side of each angular perforation is substantially coincident with a line extending between an end of line of weakness 110 and an end of line of weakness 120, and the other side of each angular perforation is oriented toward removable region 122 rather than toward frame region 124. The vertex of each angular perforation of line of weakness 114 is oriented in the direction of line of weakness 116, as shown in FIG. 1A. The series of angular perforations comprising line of weakness 114 is arranged so that one side of each angular perforation is substantially coincident with a line extending between an end of line of weakness 110 and an end of line of weakness 116, and the other side of each angular perforation is oriented toward removable region 122 rather than toward frame region 124.

In at least one embodiment of label 100, the angle between line of weakness 112 and lines of weakness 120 is greater than 90°. In at least one embodiment of label 100, the angle between line of weakness 114 and lines of weakness 116 is greater than 90°. In at least one embodiment of label 100, the angle between line of weakness 118 and line of weakness 120 is about 90°. In at least one embodiment of label 100, the angle between line of weakness 118 and line of weakness 116 is about 90°. The use of angular perforations in lines of weakness 112, 114, and the obtuse angles between line of weakness 112 and lines of weakness 120 and between line of weakness 114 and lines of weakness 116, facilitates removal of removable region 122 from frame 124 in one motion without tearing the material of removable region 122.

Figure 1B:
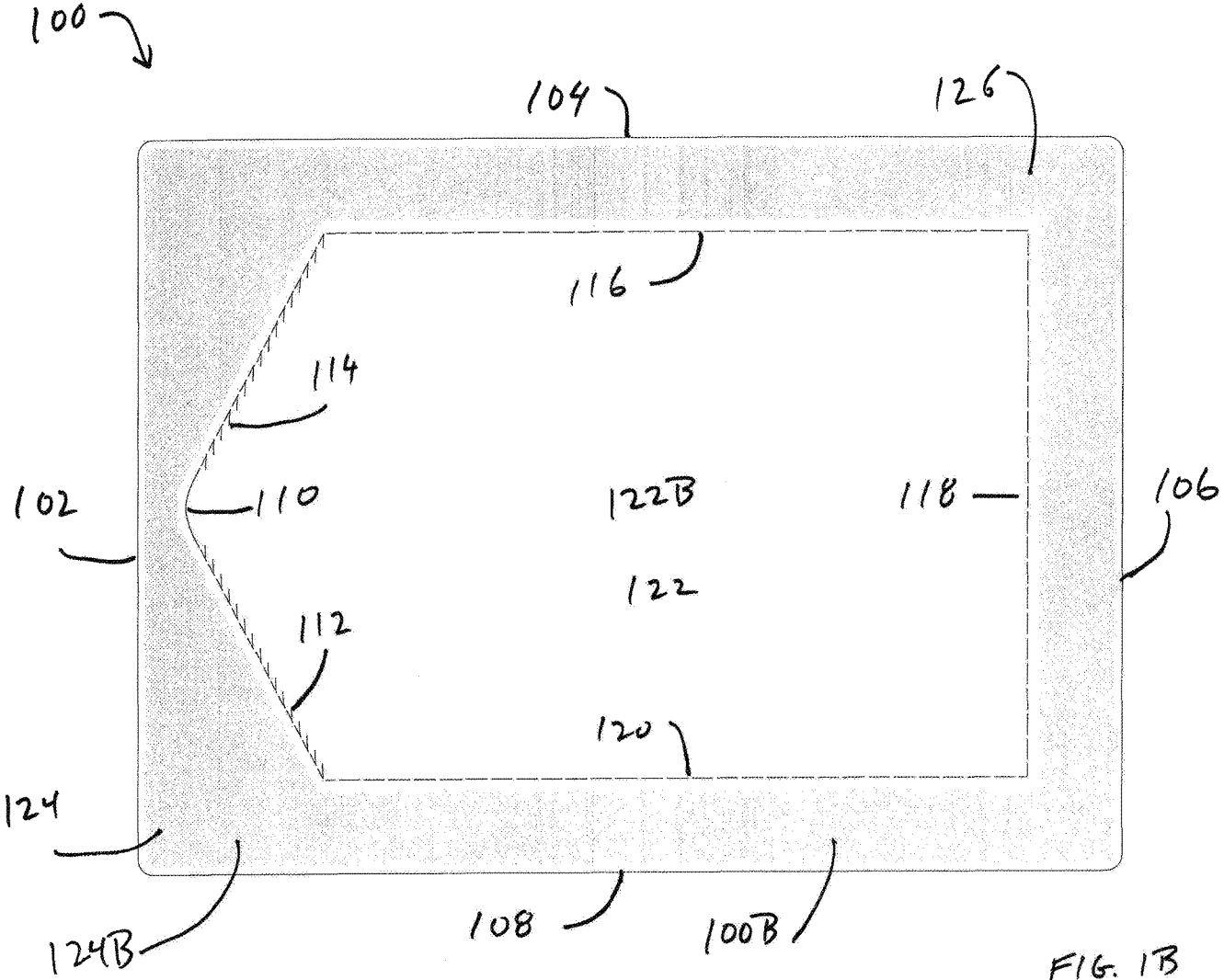
FIG. 1B shows the lower side of a label according to at least one embodiment of the present disclosure.

FIG. 1B shows lower side 100B of label 100 according to at least one embodiment of the present disclosure. Shown in FIG. 1B are label 100 bounded by leading edge 102, trailing 106, and side edges 104, 108. Removable region 122 also is shown in FIG. 1B, bounded by lines of weakness 110, 112, 114, 116, 118, 120. Frame region 124 also is shown in FIG. 1B, comprising the area of label 100 outside of lines of weakness 110, 112, 114, 116, 118, 120, but within leading edge 102, trailing edge 106, and side edges 104, 108. As shown in FIG. 1B, removable region 122 comprises removable region lower surface 122B. As shown in FIG. 1B, frame region 124 comprises frame region lower surface 124B. As shown in FIG. 1B, frame region lower surface 124B is at least partially covered with adhesive 126, while removable region lower surface 122B has reduced adhesive properties or may be completely free of adhesive. In at least one embodiment of the present disclosure, label 100 is provided on a carrier (not shown), wherein adhesive 126 on frame region lower surface 124B is removably adhered to the carrier. For example, such a carrier may be a silicone coated liner material of a type known in the art, and adhesive 126 may be of a type that removably adheres to a silicone coated liner material, but also permanent or semi-permanently adheres to other surfaces. In at least one embodiment of the present disclosure, indicia is added to lower side 100B of label 100. For example, indicia may be added to removable region lower surface 122B of label 100, or to any adhesive-free area of frame region lower surface 124B of label 100, or to both removable region lower surface 122B and to any adhesive-free area of frame region lower surface 124B of label 100.

Figure 2A:
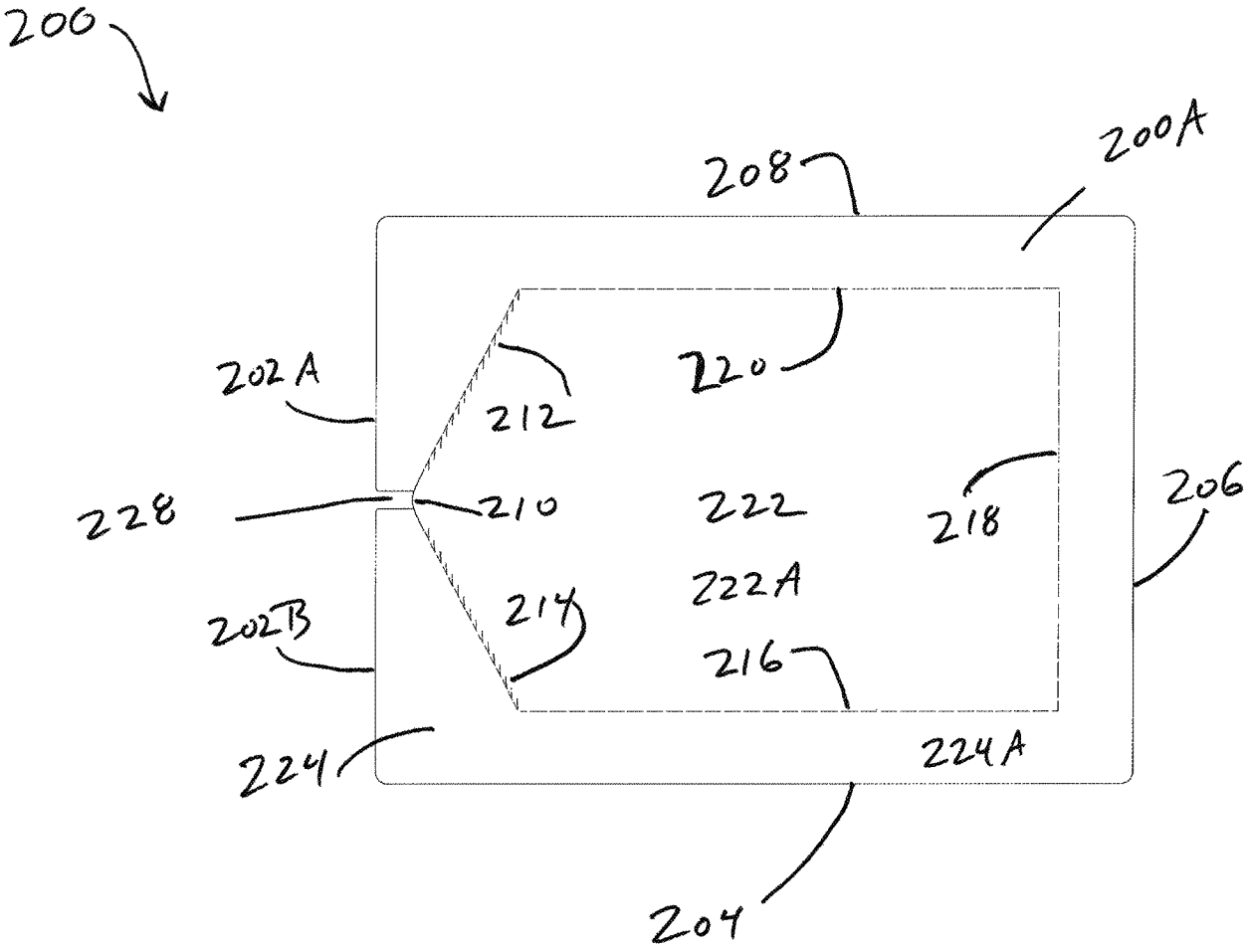
FIG. 2A shows the upper side of a label according to at least one embodiment of the present disclosure.

FIG. 2A shows upper side 200A of label 200 according to at least one embodiment of the present disclosure. In at least one embodiment of the present disclosure, label 200 comprises a label stock material such as, for example, paper, polyester, or another polymer material. In at least one embodiment of the present disclosure, label 200 comprises a label stock material receptive to the printing of indicia thereon. For example, label 200 may be exposed to an ink jet printer, a laser printer, a thermal transfer printer, a direct thermal printer, or another type of printing device capable of applying indicia to label 200. The inks, toners, and/or other printing materials used in the application of indicia to label 200 are selected to be compatible with the printing device used to apply such indicia, the material used for label 200, and the intended use of label 200.

As shown in FIG. 2A, label 200 is bounded by leading edge 202A, 202B, trailing 206, and side edges 204, 208. Label 200 also comprises removable region 222 and frame region 224. Removable region 222 comprises removable region upper surface 222A, and is bounded by lines of weakness 210, 212, 214, 216, 218, 220. Frame region 224 comprises the portion of label 200 outside of lines of weakness 210, 212, 214, 216, 218, 220, but within leading edge 202A, 202B, trailing edge 206, and side edges 204, 208. As shown in FIG. 2A, frame region 224 comprises frame region upper surface 224A. In at least one embodiment of the present disclosure, indicia is added to upper side 200A of label 200. For example, indicia may be added to removable region upper surface 222A of label 200, or to frame region upper surface 224A of label 200, or to both removable region upper surface 222A and frame region upper surface 224A of label 200.

Lines of weakness 210, 212, 214, 216, 218, 220 serve to weaken the boundary between removal region 222 and frame region 224, facilitating the removal of removable region 222 from frame region 224 as discussed hereinafter. Lines of weakness 210, 212, 214, 216, 218, 220 may comprise cuts or perforations that extend partially or completely through label 200. In at least one embodiment of label 200, lines of weakness 210, 212, 214, 216, 218, 220 are inboard of the boundary of label 200 formed from leading edge 202A, leading edge 202B, trailing edge 206, and side edges 204, 208.

In at least one embodiment of label 200, line of weakness 210 comprises a curvilinear cut that completely severs removable region 222 from frame region 224. In at least one embodiment of label 200, line of weakness 210 comprises a curvilinear cut that is the connecting an end of line of weakness 212 to an end of line of weakness 214. In the embodiment of label 200 shown in FIG. 2A, a portion of frame region 224 is removed to form notch 228. In the embodiment of label 200 shown in FIG. 2A, notch 228 exposes line of weakness 210.

In at least one embodiment of label 200, lines of weakness 212, 214 comprise a series of angular perforations generally having a V-shape or a Y-shape. The vertex of each angular perforation of line of weakness 212 is oriented in the direction of line of weakness 220, as shown in FIG. 2A. The series of angular perforations comprising line of weakness 212 is arranged so that one side of each angular perforation is substantially coincident with a line extending between an end of line of weakness 210 and an end of line of weakness 220, and the other side of each angular perforation is oriented toward removable region 222 rather than toward frame region 224. The vertex of each angular perforation of line of weakness 214 is oriented in the direction of line of weakness 216, as shown in FIG. 2A. The series of angular perforations comprising line of weakness 214 is arranged so that one side of each angular perforation is substantially coincident with a line extending between an end of line of weakness 210 and an end of line of weakness 216, and the other side of each angular perforation is oriented toward removable region 222 rather than toward frame region 224.

In at least one embodiment of label 200, the angle between line of weakness 212 and lines of weakness 220 is greater than 90°. In at least one embodiment of label 200, the angle between line of weakness 214 and lines of weakness 216 is greater than 90°. In at least one embodiment of label 200, the angle between line of weakness 218 and line of weakness 220 is about 90°. In at least one embodiment of label 200, the angle between line of weakness 218 and line of weakness 216 is about 90°. The use of angular perforations in lines of weakness 212, 214, and the obtuse angles between line of weakness 212 and lines of weakness 220 and between line of weakness 214 and lines of weakness 216, facilitates removal of removable region 222 from frame 224 in one motion without tearing the material of removable region 222.

Figure 2B:
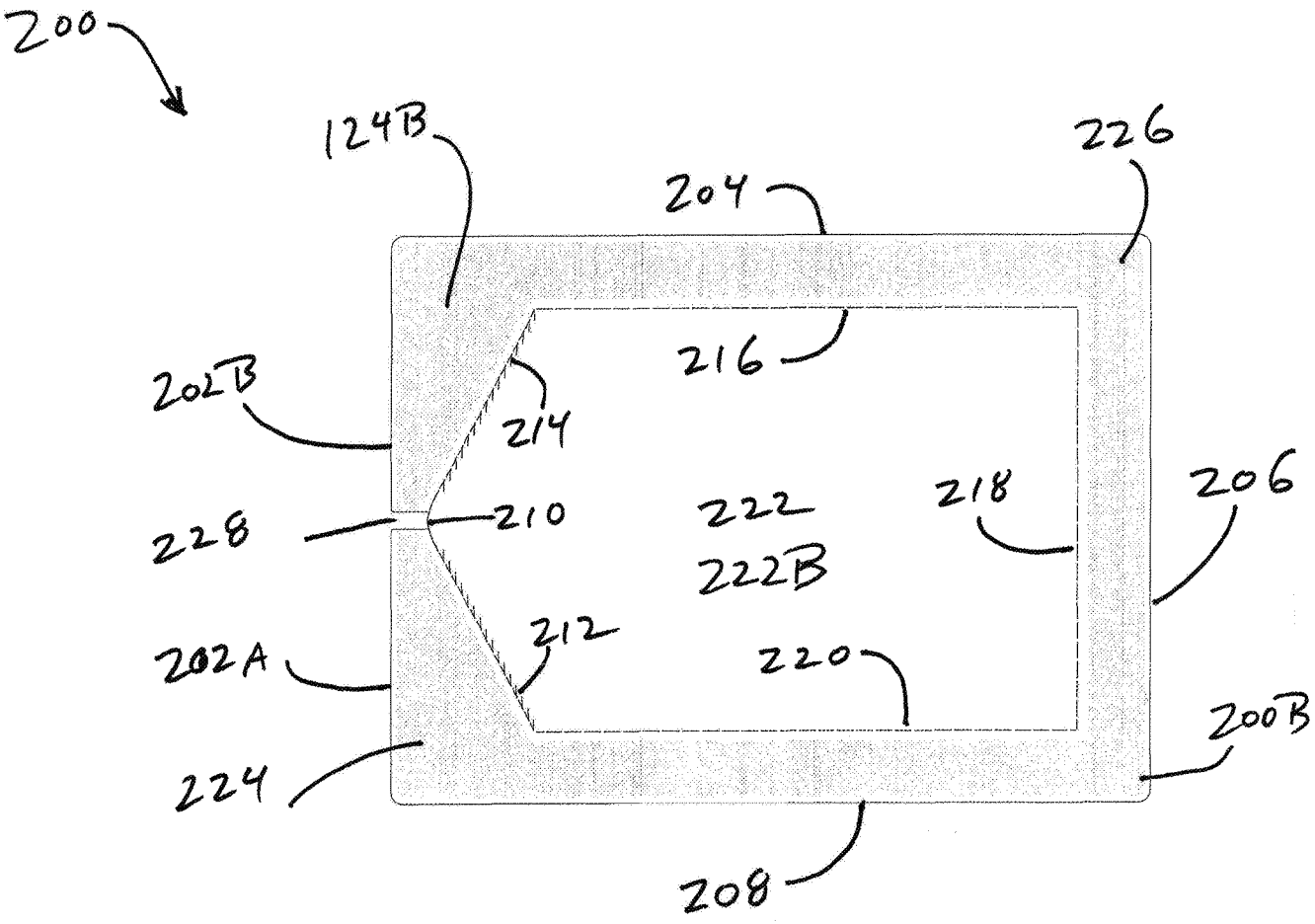
FIG. 2B shows the lower side of a label according to at least one embodiment of the present disclosure.

FIG. 2B shows lower side 200B of label 200 according to at least one embodiment of the present disclosure. Shown in FIG. 2B are label 200 bounded by leading edge 202A, 202B, trailing 206, and side edges 204, 208. Removable region 222 also is shown in FIG. 2B, bounded by lines of weakness 210, 212, 214, 216, 218, 220. Frame region 224 also is shown in FIG. 2B, comprising the area of label 200 outside of lines of weakness 210, 212, 214, 216, 218, 220, but within leading edge 202A, 202B, trailing edge 206, and side edges 204, 208. Notch 228 also is shown on FIG. 2B.

As shown in FIG. 2B, removable region 222 comprises removable region lower surface 222B. As shown in FIG. 2B, frame region 224 comprises frame region lower surface 224B. As shown in FIG. 2B, frame region lower surface 224B is at least partially covered with adhesive 226, while removable region lower surface 222B has reduced adhesive properties or may be completely free of adhesive. In at least one embodiment of the present disclosure, label 200 is provided on a carrier (not shown), wherein adhesive 226 on frame region lower surface 224B is removably adhered to the carrier. For example, such a carrier may be a silicone coated liner material of a type known in the art, and adhesive 226 may be of a type that removably adheres to a silicone coated liner material, but also permanent or semi-permanently adheres to other surfaces. In at least one embodiment of the present disclosure, indicia is added to lower side 200B of label 200. For example, indicia may be added to removable region lower surface 222B of label 200, or to any adhesive-free area of frame region lower surface 224B of label 200, or to both removable region lower surface 222B and to any adhesive-free area of frame region lower surface 224B of label 200.

Figure 3A:
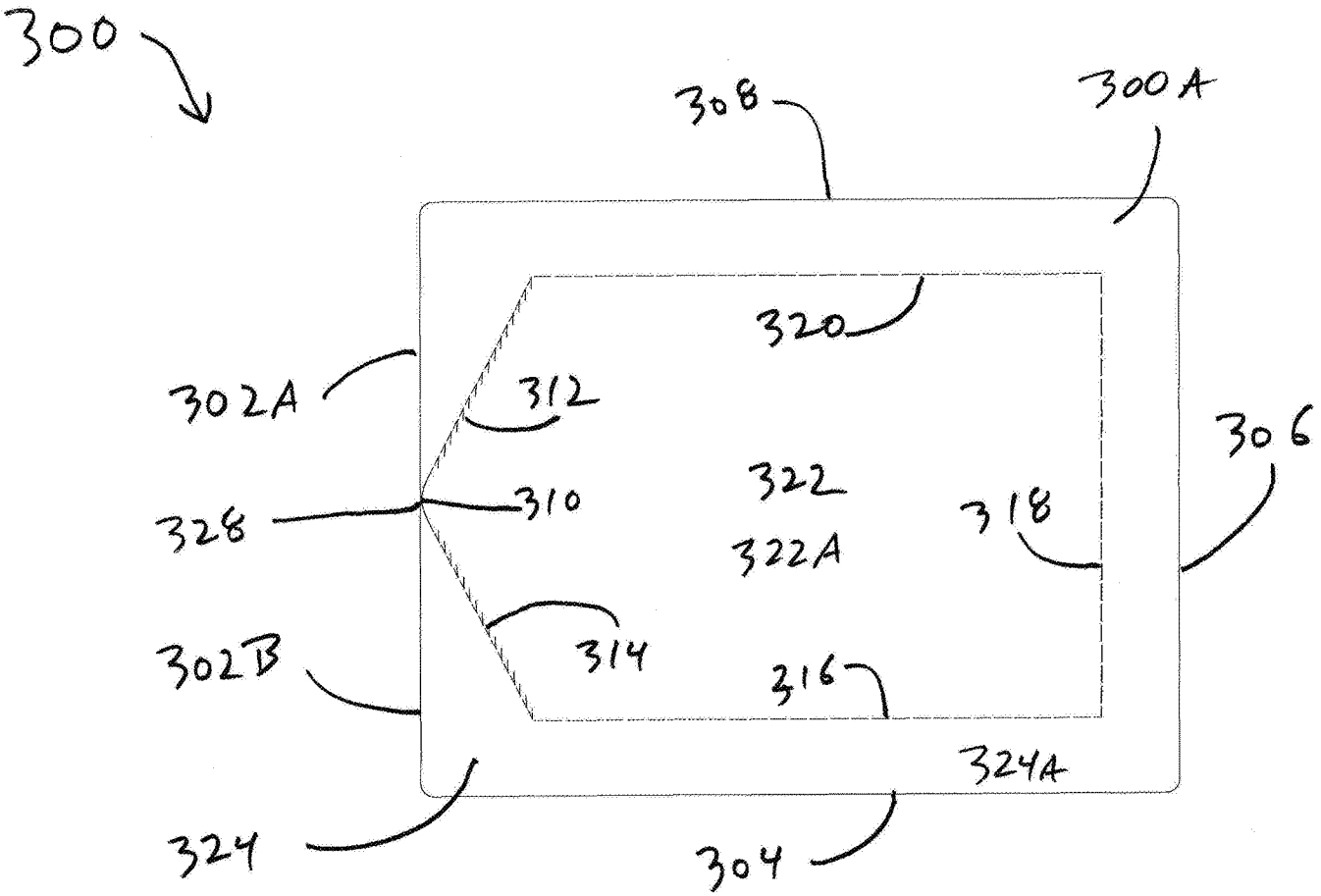
FIG. 3A shows the upper side of a label according to at least one embodiment of the present disclosure.

FIG. 3A shows upper side 300A of label 300 according to at least one embodiment of the present disclosure. In at least one embodiment of the present disclosure, label 300 comprises a label stock material such as, for example, paper, polyester, or another polymer material. In at least one embodiment of the present disclosure, label 300 comprises a label stock material receptive to the printing of indicia thereon. For example, label 300 may be exposed to an ink jet printer, a laser printer, a thermal transfer printer, a direct thermal printer, or another type of printing device capable of applying indicia to label 300. The inks, toners, and/or other printing materials used in the application of indicia to label 300 are selected to be compatible with the printing device used to apply such indicia, the material used for label 300, and the intended use of label 300.

As shown in FIG. 3A, label 300 is bounded by leading edge 302A, 302B, trailing 306, and side edges 304, 308. Label 300 also comprises removable region 322 and frame region 324. Removable region 322 comprises removable region upper surface 322A, and is bounded by lines of weakness 310, 312, 314, 316, 318, 320. Frame region 324 comprises the portion of label 300 outside of lines of weakness 310, 312, 314, 316, 318, 320, but within leading edge 302A, 302B, trailing edge 306, and side edges 304, 308. As shown in FIG. 3A, frame region 324 comprises frame region upper surface 324A. In at least one embodiment of the present disclosure, indicia is added to upper side 300A of label 300. For example, indicia may be added to removable region upper surface 322A of label 300, or to frame region upper surface 324A of label 300, or to both removable region upper surface 322A and frame region upper surface 324A of label 300.

Lines of weakness 310, 312, 314, 316, 318, 320 serve to weaken the boundary between removable region 322 and frame region 324, facilitating the removal of removable region 322 from frame region 324 as discussed hereinafter. Lines of weakness 310, 312, 314, 316, 318, 320 may comprise cuts or perforations that extend partially or completely through label 300.

In at least one embodiment of label 300, line of weakness 310 comprises a curvilinear cut that completely severs removable region 322 from frame region 324. In at least one embodiment of label 300, line of weakness 310 comprises a curvilinear cut that is connecting an end of line of weakness 312 to an end of line of weakness 314. In at least one embodiment of label 300, line of weakness 310 comprises a curvilinear cut comprising apex 328. In at least one embodiment of label 300, apex 328 of line of weakness 310 intersects leading edge 302A, 302B. In at least one such embodiment of label 300, lines of weakness 312, 314, 316, 318, 320 are inboard of the boundary of label 300 formed by leading edge 302A, leading edge 302B, trailing edge 306, and side edges 304, 308.

In at least one embodiment of label 300, lines of weakness 312, 314 comprise a series of angular perforations generally having a V-shape or a Y-shape. The vertex of each angular perforation of line of weakness 312 is oriented in the direction of line of weakness 320, as shown in FIG. 3A. The series of angular perforations comprising line of weakness 312 is arranged so that one side of each angular perforation is substantially coincident with a line extending between an end of line of weakness 310 and an end of line of weakness 320, and the other side of each angular perforation is oriented toward removable region 322 rather than toward frame region 324. The vertex of each angular perforation of line of weakness 314 is oriented in the direction of line of weakness 316, as shown in FIG. 3A. The series of angular perforations comprising line of weakness 314 is arranged so that one side of each angular perforation is substantially coincident with a line extending between an end of line of weakness 310 and an end of line of weakness 316, and the other side of each angular perforation is oriented toward removable region 322 rather than toward frame region 324.

In at least one embodiment of label 300, the angle between line of weakness 312 and lines of weakness 320 is greater than 90°. In at least one embodiment of label 300, the angle between line of weakness 314 and lines of weakness 316 is greater than 90°. In at least one embodiment of label 300, the angle between line of weakness 318 and line of weakness 320 is about 90°. In at least one embodiment of label 300, the angle between line of weakness 318 and line of weakness 316 is about 90°. The use of angular perforations in lines of weakness 312, 314, and the obtuse angles between line of weakness 312 and lines of weakness 320 and between line of weakness 314 and lines of weakness 316, facilitates removal of removable region 322 from frame 324 in one motion without tearing the material of removable region 322.

Figure 3B:
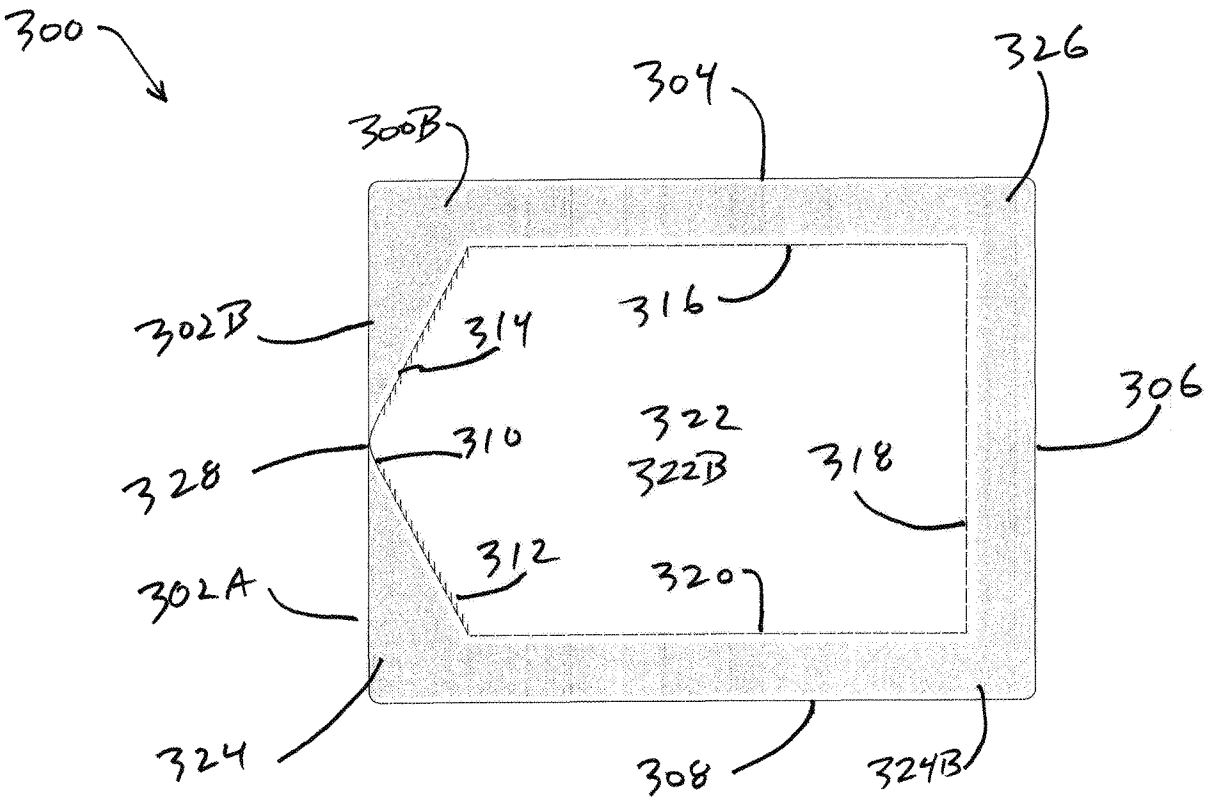
FIG. 3B shows the lower side of a label according to at least one embodiment of the present disclosure.

FIG. 3B shows lower side 300B of label 300 according to at least one embodiment of the present disclosure. Shown in FIG. 3B are label 300 bounded by leading edge 302A, 302B, trailing 306, and side edges 304, 308. Removable region 322 also is shown in FIG. 3B, bounded by lines of weakness 310, 312, 314, 316, 318, 320. Frame region 324 also is shown in FIG. 3B, comprising the area of label 300 outside of lines of weakness 310, 312, 314, 316, 318, 320, but within leading edge 302A, 302B, trailing edge 306, and side edges 304, 308. Apex 328 of line of weakness 310 also is shown on FIG. 3B.

As shown in FIG. 3B, removable region 322 comprises removable region lower surface 322B. As shown in FIG. 3B, frame region 324 comprises frame region lower surface 324B. As shown in FIG. 3B, frame region lower surface 324B is at least partially covered with adhesive 326, while removable region lower surface 322B has reduced adhesive properties or may be completely free of adhesive. In at least one embodiment of the present disclosure, label 300 is provided on a carrier (not shown), wherein adhesive 326 on frame region lower surface 324B is removably adhered to the carrier. For example, such a carrier may be a silicone coated liner material of a type known in the art, and adhesive 326 may be of a type that removably adheres to a silicone coated liner material, but also permanent or semi-permanently adheres to other surfaces. In at least one embodiment of the present disclosure, indicia is added to lower side 300B of label 300. For example, indicia may be added to removable region lower surface 322B of label 300, or to any adhesive-free area of frame region lower surface 324B of label 300, or to both removable region lower surface 322B and to any adhesive-free area of frame region lower surface 324B of label 300.

Figure 4:
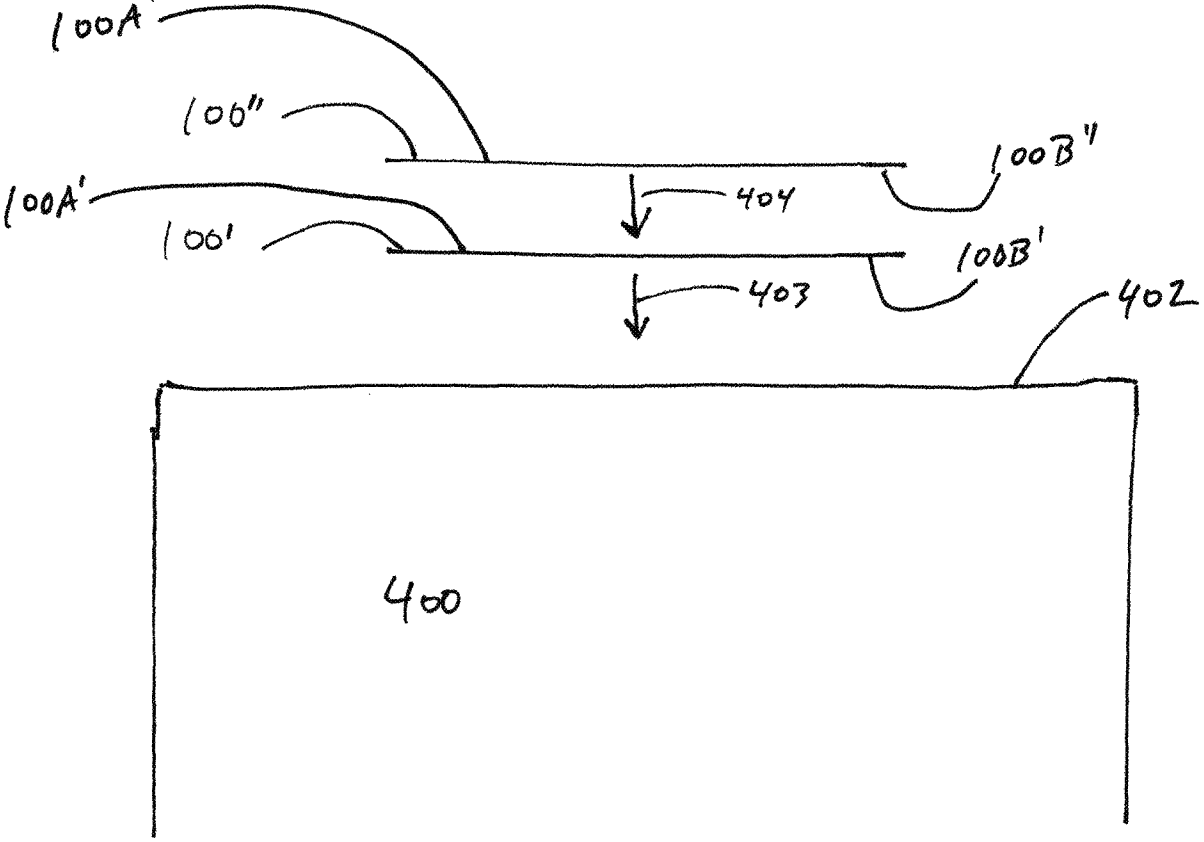
FIG. 4 shows two labels applied to a carton, according to at least one embodiment of the present disclosure.

FIG. 4 shows the application of label 100 to carton 400 according to at least one embodiment of the present disclosure. As shown in FIG. 4, according to at least one embodiment of the present disclosure a pair of labels 100 (identified as lower label 100' and upper label 100" in FIG. 4) are applied to carton 400, either mechanically (such as, for example, by a label applicator apparatus) or by hand.

In at least one embodiment of the present disclosure, prior to or in conjunction with the application of lower label 100' to carton 400, indicia is added to removable region upper surface 122A of lower label 100'. For example, where lower label 100' is intended to serve as a packing list, such indicia may comprise the contents of carton 400.

For purposes of applying lower label 100' to carton 400, lower label 100' is oriented such that lower side 100B' of lower label 100' faces carton 400. Lower label 100' is moved in the direction shown by arrow 403 until adhesive 126 on lower side 100B' of lower label 100' comes into contact with upper surface 402 of carton 400. Adhesive 126 on lower side 100B' of lower label 100' permanent or semi-permanently adheres frame region lower surface 124B of lower label 100' to upper surface 402 of carton 400. Removable region lower surface 122B of lower label 100' also is adjacent to upper surface 402 of carton 400, but because removable region lower surface 122B of lower label 100' has reduced adhesive properties or may be completely free of adhesive, removable region lower surface 122B of lower label 100' does not adhere to upper surface 402 of carton 400.

In at least one embodiment of the present disclosure, upper label 100" is applied over, and in registration with, lower label 100'. In at least one embodiment, prior to or in conjunction with the application of upper label 100" to carton 400, indicia is added to upper side 100A" of upper label 100", such as within removable region upper surface 122A of upper label 100". For example, where upper label 100" is intended to serve as a shipper label, such indicia may comprise the address to which carton 400 is to be shipped, a return address, bar codes, maxicodes, identifying numbers, and the like.

For purposes of applying upper label 100" to lower label 100', upper label 100" is oriented such that lower side 100B" of upper label 100" faces upper side 100A' upper side 100A'. Upper label 100" is moved in the direction shown by arrow 404 until adhesive 126 on lower side 100B" of upper label 100" comes into contact with upper side 100A' of lower label 100'. Adhesive 126 on lower side 100B" of upper label 100" permanent or semi-permanently adheres frame region lower surface 124B of upper label 100" to frame region upper surface 124A of lower label 100'. Removable region lower surface 122B of upper label 100" also is adjacent to, and in registration with, removable region upper surface 122A of lower label 100', but because removable region lower surface 122B of upper label 100" has reduced adhesive properties or may be completely free of adhesive, removable region lower surface 122B of upper label 100" does not adhere to removable region upper surface 122A of lower label 100'.

It also is within the scope of the present disclosure that upper label 100" may be adhered to lower label 100' in the manner described above before lower label 100' is applied to upper surface 402 of carton 400. In such an embodiment, after upper label 100" is adhered to lower label 100', the adhered-together labels 100 then are applied simultaneously to carton 400.

After being presented with this disclosure, those skilled in the art will appreciate that a pair of labels 200 or a pair of labels 300 may be applied to a shipping carton 400 in the same manner as described above with respect to the pair of labels 100.

A person in possession of carton 400 (such as the recipient of carton 400) with the pair of labels 100 adhered thereto may remove removable region 122 of upper label 100" to reveal removable region 122 of lower label 100'. For example, a person in possession of carton 400 (such as the recipient of carton 400) may be interested in knowing the contents of carton 400, and removable region 122 of lower label 100' may be a packing list comprising indicia that reveals the contents of carton 400.

In at least one embodiment, because removable region 122 of upper label 100" is not adhered to lower label 100', removable region 122 of upper label 100" may be removed from frame region 124 of upper label 100" by first separating removable region 122 of upper label 100" from frame region 124 of upper label 100" at line of weakness 110, such as by inserting a fingernail or other implement through line of weakness 110 and lifting the portion of removable region 122 of upper label 100" adjacent line of weakness 110. After the portion of removable region 122 adjacent line of weakness 110 is separated from frame region 124, the remainder of removable region 122 of upper label 100" may be separated from frame region 124 of upper label 100" along lines of weakness 112, 114, 116, 118, 120, and, if desired, fully removed from upper label 100". Frame region 124 of upper label 100" remains adhered to lower label 100'.

Similarly, in at least one embodiment, because removable region 122 of lower label 100" is not adhered to carton 400, removable region 122 of lower label 100' may be removed from frame region 124 of lower label 100' by first separating removable region 122 of lower label 100' from frame region 124 of lower label 100' at line of weakness 110, such as by inserting a fingernail or other implement through line of weakness 110 and lifting the portion of removable region 122 of lower label 100' adjacent line of weakness 110. After the portion of removable region 122 adjacent line of weakness 110 is separated from frame region 124, the remainder of removable region 122 of lower label 100' may be separated from frame region 124 of lower label 100' along lines of weakness 112, 114, 116, 118, 120, and, if desired, fully removed from lower label 100'. Frame region 124 of lower label 100' remains adhered to carton 400.

After being presented with this disclosure, those skilled in the art will appreciate that removable region 222 of label 200 may be partially or fully removed from frame region 224 of label 200 in a similar manner as described above with respect to label 100. Notch 228 of label 200 facilitates access to line of weakness 210 of label 200, which may enhance the ease of removing removable region 222 from frame region 224 of label 200.

After being presented with this disclosure, those skilled in the art will appreciate that removable region 322 of label 300 may be partially or fully removed from frame region 324 of label 300 in a similar manner as described above with respect to label 100. The intersection of apex 328 with leading edge 302A, 302B of label 300 facilitates access to line of weakness 310 of label 300, which may enhance the ease of removing removable region 322 from frame region 324 of label 300.

While this disclosure has been described as having preferred designs, the apparatus and methods according to the present disclosure can be further modified within the scope and spirit of this disclosure. This application is therefore intended to cover any variations, uses, or adaptations of the disclosure using its general principles. For example, any method disclosed herein and in the appended claims represent one possible sequence of performing the steps thereof. A practitioner may determine in a particular implementation that a plurality of steps of one or more of the disclosed methods may be combinable, or that a different sequence of steps may be employed to accomplish the same results. Each such implementation falls within the scope of the present disclosure as disclosed herein and in the appended claims. Furthermore, this application is intended to cover such departures from the present disclosure as come within known or customary practice in the art to which this disclosure pertains.

We claim:

1. A label comprising:

a sheet material, said sheet material comprising an upper side and an opposing lower side, said sheet material bounded by a leading edge, a trailing edge, and first and second side edges, said sheet material comprising a network of connected lines of weakness defining a removable region and a frame region in said sheet material, said removable region encompassed within said network of connected lines of weakness, said network of connected lines of weakness comprising a first line of weakness oriented parallel to said first edge and having a leading end and a trailing end, a second line of weakness oriented parallel to said second edge and having a leading end and a trailing end, a third line of weakness oriented parallel to said trailing edge and connected to said trailing end of said first line of weakness and to said trailing end of said second line of weakness, a fourth line of weakness connected to said leading end of said first line of weakness and arranged at an obtuse angle to said first line of weakness, a fifth line of weakness connected to said leading end of said second line of weakness and arranged at an obtuse angle to said second line of weakness, and at least one non-linear cut extending between said fourth line of weakness and said fifth line of weakness, said at least one non-linear cut separating said sheet material of said removable region from said sheet material of said flame region, said at least one non-linear cut comprising a liftable apex, wherein said fourth line of weakness comprises a series of angular perforations, each said angular perforation comprising a vertex, each said vertex oriented in the same direction, each said angular perforation arranged so that one leg of each said angular perforation is coincident with said fourth line of weakness and another leg of each said angular perforation is oriented toward said removable region and away from said frame region, wherein when said liftable apex is lifted from an adjacent part of said frame region toward said trailing edge said removable region is detached from said frame region, beginning at said fourth line of weakness and said fifth line of weakness, then at said first line of weakness and said second line of weakness, and then at said third line of weakness.

2. A label comprising:

a sheet material, said sheet material having an upper side and an opposing lower side, said upper side and said lower side bounded by a leading edge, a trailing edge, and first and second side edges connecting said leading edge and said trailing edge;

a first line of weakness in said material, said first line of weakness having a leading end and a trailing end;

a second line of weakness in said sheet material, said second line of weakness having a leading end and a trailing end;

a third line of weakness in said sheet material, said third line of weakness connected to said trailing end of said first line of weakness and to said trailing end of said second line of weakness;

fourth line of weakness is said sheet material, said fourth line of weakness connected to said leading end of said first line of weakness and arranged at an obtuse angle to said first line of weakness;

a fifth line of weakness in said sheet material, said fifth line of weakness connected to said leading end of said second line of weakness and arranged at an obtuse angle to said second line of weakness;

a non-linear line of weakness in said sheet material, said non-linear line of weakness connecting said fourth line of weakness to said fifth line of weakness;

a removable region in said sheet material, said removable region being within said first line of weakness, said second line of weakness, said third line of weakness, said fourth line of weakness, said fifth line of weakness, and said nonlinear line of weakness, wherein said removable region is entirely inboard of said leading edge, said trailing edge, and said first and second side edges, and wherein at least a portion of said lower side of said removable region is free of adhesive;

a frame region in said sheet material around said removable region, said frame region located between said leading edge, said trailing edge, and said first and second side edges and said first line of weakness, said second line of weakness, said third line of weakness, said fourth line of weakness, said fifth line of weakness, and said non-linear line of weakness; and adhesive on at least a portion of said frame region of said lower side.

3. The label of claim 2, further comprising:

a series of angular perforations intersecting with at least a portion of at least one of said first line of weakness, said second line of weakness, said third line of weakness, said fourth line of weakness, and said fifth line of weakness, each said angular perforation comprising two legs meeting at a vertex, each said vertex oriented in the same direction, each said angular perforation arranged so that one said leg of each said angular perforation is coincident with at least one of said first line of weakness, said second line of weakness, said third line of weakness, said fourth line of weakness, and said fifth line of weakness and another said leg of each said angular perforation is oriented from said vertex toward said removable region and away from said frame region.

4. The label of claim 2, further comprising:

a series of angular perforation intersecting with at least a portion of said fourth line of weakness, each said angular perforation comprising two legs meeting at a vertex, each said vertex oriented in the same direction, each said angular perforation arranged so that one said leg of each said angular perforation is coincident with said fourth line of weakness and another said leg of each said angular perforation is oriented from said vertex toward said removable region and away from said frame region.

5. The label of claim 4, further comprising:

a series of angular perforations intersecting with at least a portion of said fifth line of weakness, each said angular perforation comprising two legs meeting at a vertex, each said vertex oriented in the same direction, each said angular perforation arranged so that one said leg of each said angular perforation is coincident with said fifth line of weakness and another said leg of each said angular perforation is oriented from said vertex toward said removable region and away from said frame region.

6. The label of claim 2, wherein said non-linear line of weakness comprises a liftable apex, and wherein when said liftable apex is lifted from an adjacent part of said frame region toward said trailing edge said removable region is detached from said frame region, beginning at said fourth line of weakness and said fifth line of weakness, then at said first line of weakness and said second line of weakness, and then at said third line of weakness.

7. A label comprising:

a sheet material having an upper side and an opposing lower side, said upper side and said lower side bounded by a leading edge, a trailing edge, and first and second side edges connecting said leading edge and said trailing edge;

a first line of weakness in said sheet material, said first line of weakness having a leading end and a trailing end;

a second line of weakness in said sheet material, said second line of weakness having a leading end and a trailing end;

a third line of weakness in said sheet material, said third line of weakness connected to said trailing end of said first line of weakness and to said trailing end of said second line of weakness;

a fourth line of weakness in said sheet material, said fourth line of weakness connected to said leading end of said first line of weakness and arranged at an obtuse angle to said first line of weakness;

a fifth line of weakness in said sheet material, said fifth line of weakness connected to said leading end of said second line of weakness and arranged at an obtuse angle to said second line of weakness;

a non-linear line of weakness in said sheet material, said non-linear line of weakness connecting said fourth line of weakness to said fifth line of weakness;

a removable region in said sheet material, said removable region encompassed within said first line of weakness, said second line of weakness, said third line of weakness, said fourth line of weakness, said fifth line of weakness, and said non-linear line of weakness, wherein said removable region is entirely inboard of said leading edge, said trailing edge, and said first and second side edges, wherein at least a portion of said lower side of said removable region is free of adhesive;

a frame region in said sheet material around said removable region between said leading edge, said trailing edge, and said first and second side edges and said first line of weakness, said second line of weakness, said third line of weakness, said fourth line of weakness, said fifth line of weakness, and said non-linear line of weakness;

a void in said sheet material located between said non-linear line of weakness and said leading edge; and adhesive on at least a portion of said frame region of said lower side.

8. The label of claim 7, further comprising:

series of angular perforations intersecting with at least a portion of at least one of said first line of weakness, said second line of weakness, said third line of weakness, said fourth line of weakness, and said fifth line of weakness, each said angular perforation comprising two legs meeting at a vertex, each said vertex oriented in the same direction, each said angular perforation arranged so that one said leg of each said angular perforation is coincident with at least one of said first line of weakness, said second line of weakness, said third line of weakness, said fourth line of weakness, and said fifth line of weakness and another said leg of each said angular perforation is oriented from said vertex toward said removable region and away from said frame region.

9. The label of claim 7, further comprising:

a series of angular perforations intersecting with at least a portion of said fourth line of weakness, each said angular perforation comprising two legs meeting at a vertex, each said vertex oriented in the same direction, each said angular perforation arranged so that one said leg of each said angular perforation is coincident with said fourth line of weakness and another said leg of each said angular perforation is oriented from said vertex toward said removable region and away from said frame region.

10. The label of claim 9, further comprising:

a series of angular perforations intersecting with at least a portion of said fifth line of weakness, each said angular perforation comprising two legs meeting at a vertex, each said vertex oriented in the same direction, each said angular perforation arranged so that one said leg of each said angular perforation is coincident with said fifth line of weakness and another said leg of each said angular perforation is oriented from said vertex toward said removable region and away from said frame region.

11. The label of claim 7, wherein said non-linear line of weakness comprises a liftable apex, and wherein when said liftable apex is lifted from an adjacent part of said frame region toward said trailing edge said removable region is detached from said frame region, beginning at said fourth line of weakness and said fifth line of weakness, then at said first line of weakness and said second line of weakness, and then at said third line of weakness.

12. A label comprising:

a sheet material having an upper side and an opposing lower side, said upper side and said lower side bounded by a leading edge, a trailing edge, and first and second side edges connecting said leading edge and said trailing edge;

a first line of weakness in said sheet material, said first line of weakness having a leading end and a trailing end;

a second line of weakness in said sheet material, said second line of weakness having a leading end and a trailing end;

a third line of weakness in said sheet material, said third line of weakness connected to said trailing end of said first line of weakness and to said trailing end of said second line of weakness;

a fourth line of weakness in said sheet material, said fourth line of weakness connected to said leading end of said first line of weakness and arranged at an obtuse angle to said second line of weakness;

a fifth line of weakness in said sheet material, said fifth line of weakness connected to said leading end of said second line of weakness and arranged at an obtuse angle to said second line of weakness;

non-linear line of weakness in said sheet material, said non-linear line of weakness connecting said fourth line of weakness to said fifth line of weakness, said non-linear line of weakness having an apex oriented toward and intersecting with said leading edge;

a removable region in said sheet material, said removable region being within said first line of weakness, said second line of weakness, said third line of weakness, said fourth line of weakness, said fifth line of weakness, and said non-linear line of weakness, wherein at least a portion of said lower side of said removable region is free of adhesive;

a frame region in said sheet material around said removable region between said leading edge, said trailing edge, and said first and second side edges and said first line of weakness, said second line of weakness, said third line of weakness, said fourth line of weakness, said fifth line of weakness, and said non-linear line of weakness; and adhesive on at least a portion of said frame region of said lower side.

13. The label of claim 12, further comprising:

a series of angular perforations intersecting with at least a portion of at least one of said first line of weakness, said second line of weakness, said third line of weakness, said fourth line of weakness, and said fifth line of weakness, each said angular perforation comprising two legs meeting at a vertex, each said vertex oriented in the same direction, each said angular perforation arranged so that one said leg of each said angular perforation is coincident with at least one of said first line of weakness, said second line of weakness, said third line of weakness, said fourth line of weakness, and said fifth line of weakness and another said leg of each said angular perforation is oriented from said vertex toward said removable region and away from said frame region.

14. The label of claim 12, further comprising:

a series of angular perforations intersecting with at least a portion of said fourth line of weakness, each said angular perforation comprising two legs meeting at a vertex, each said vertex oriented in the same direction, each said angular perforation arranged so that one said leg of each said angular perforation is coincident with said fourth line of weakness and another said leg of each said angular perforation is oriented from said vertex toward said removable region and away from said frame region.

15. The label of claim 12, further comprising:

a series of angular perforations intersecting with at least a portion of said fifth line of weakness, each said angular perforation comprising two legs meeting at a vertex, each said vertex oriented in the same direction, each said angular perforation arranged so that one said leg of each said angular perforation is coincident with said fifth line of weakness and another said leg of each said angular perforation is oriented from said vertex toward said removable region and away from said frame region.

16. The label of claim 12, wherein said apex of said non-linear line of weakness comprises a liftable apex, and wherein when said liftable apex is lifted from an adjacent part of said frame region toward said trailing edge said removable region is detached from said frame region, beginning at said fourth line of weakness and said fifth line of weakness, then at said first line of weakness and said second line of weakness, and then at said third line of weakness.

* * * * *